US008684357B2

(12) United States Patent
Brooks et al.

(10) Patent No.: US 8,684,357 B2
(45) **Date of Patent: *Apr. 1, 2014**

(54) AIR HOCKEY TABLE

(76) Inventors: Martin Brooks, Las Vegas, NV (US); Timothy Crawford, Golden, CO (US)

( * ) Notice: Subject to any disclaimer, the term of this patent is extended or adjusted under 35 U.S.C. 154(b) by 248 days.

This patent is subject to a terminal disclaimer.

(21) Appl. No.: 13/072,296

(22) Filed: Mar. 25, 2011

(65) Prior Publication Data

US 2011/0233861 A1 Sep. 29, 2011

Related U.S. Application Data

(60) Provisional application No. 61/318,782, filed on Mar. 29, 2010.

(51) Int. Cl.
*A63F 7/06* (2006.01)

(52) U.S. Cl.
USPC ..... 273/126 A

(58) Field of Classification Search
USPC ..... 273/126 R, 126 A, 108.1, 108.5, 118 R, 273/118 A, 119 R, 119 A
See application file for complete search history.

(56) References Cited

U.S. PATENT DOCUMENTS

| | | | | | |
|---|---|---|---|---|---|
| 735,995 | A * | 8/1903 | Mumford | 273/118 R |
| 2,565,238 | A * | 8/1951 | Koci | 273/126 A |
| 2,593,641 | A * | 4/1952 | Wolverton | 273/126 A |
| 3,913,918 | A * | 10/1975 | Trachtman | 273/126 R |
| 4,017,079 | A * | 4/1977 | Apellaniz | 273/126 R |
| 4,076,242 | A * | 2/1978 | Joseph | 273/108.51 |
| 4,215,863 | A * | 8/1980 | Kuiper | 273/126 R |
| 4,871,170 | A * | 10/1989 | Carini | 273/126 R |
| 4,998,729 | A * | 3/1991 | Lischerelli | 273/119 R |
| 5,368,300 | A * | 11/1994 | Becker | 273/121 R |
| 5,433,443 | A * | 7/1995 | Ples | 273/108.51 |
| 5,467,985 | A * | 11/1995 | Jones | 273/126 R |
| 5,788,231 | A * | 8/1998 | To | 273/126 R |
| 6,105,960 | A * | 8/2000 | Carames | 273/108.1 |
| 6,276,682 | B1 * | 8/2001 | Yamashita et al. | 273/126 A |
| 6,345,820 | B1 * | 2/2002 | Zucchi et al. | 273/148 R |
| 6,623,004 | B2 * | 9/2003 | Rossi et al. | 273/108.1 |
| 7,178,802 | B2 * | 2/2007 | Nally et al. | 273/108 |
| 8,025,293 | B1 * | 9/2011 | Crawford et al. | 273/126 A |
| 8,336,880 | B2 * | 12/2012 | Crawford et al. | 273/126 A |
| 2003/0116912 | A1 * | 6/2003 | Bangerter | 273/108.1 |
| 2005/0012267 | A1 * | 1/2005 | Tien | 273/126 A |
| 2005/0161878 | A1 * | 7/2005 | Nally et al. | 273/126 R |
| 2006/0082055 | A1 * | 4/2006 | Chen | 273/126 R |
| 2008/0073839 | A1 * | 3/2008 | Nally | 273/126 R |

* cited by examiner

*Primary Examiner* — Raleigh W Chiu
(74) *Attorney, Agent, or Firm* — Klaas, Law, O'Meara & Malkin PC; Robert W. Nelson

(57) ABSTRACT

Air hockey tables are disclosed herein. An embodiment of an air hockey table comprises an air hockey table comprising a playing surface that is at least partially curved; and a plurality of air paths extending through the playing surface, wherein air is emittable by the plurality of air paths, and wherein the puck is at least partially floatable on air that is emittable by the plurality of air paths.

22 Claims, 7 Drawing Sheets

AIR HOCKEY TABLE

This application claims priority from application Ser. No. 61/318,782 filed on Mar. 29, 2010 for AIR HOCKEY TABLE, which is incorporated herein.

BACKGROUND

Air hockey tables have four sides wherein two opposite sides have goals. Such tables are usually limited to two players. Some tables have two goals on the same side which allow for four players. However, two players have to stand very close to each other in order to play.

DETAILED DESCRIPTION

Figure 1:
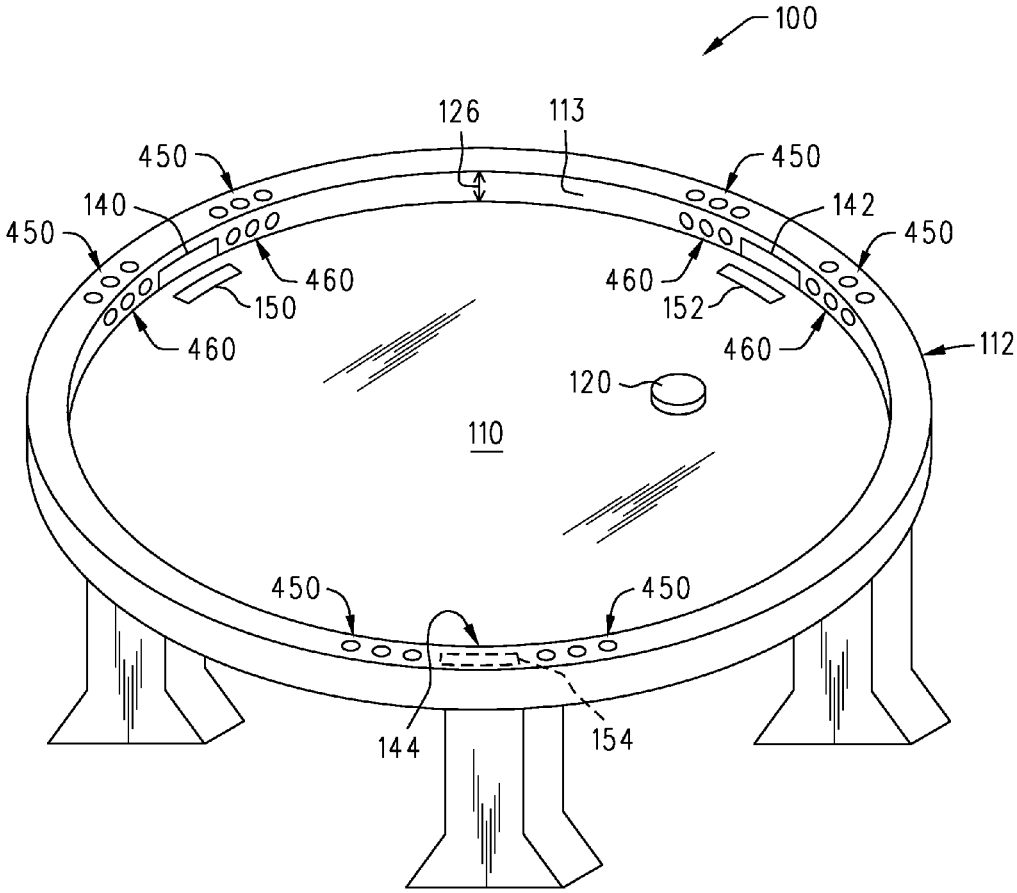
FIG. 1 is a top perspective view of an embodiment of a round or circular air hockey table.

A top perspective view of an air hockey table 100 is shown in FIG. 1. The air hockey table 100 is used to play the game of air hockey wherein the objective is to place a puck 120 in an opposing goal or to prevent the puck 120 from entering certain goals. Unlike conventional rectangular air hockey tables, the air hockey table 100 is round or at least partially curved. An at least partially curved air hockey table is one that has at least one boundary of a playing surface that is curved. A curved air hockey table includes more than simply having curved corner portions of a playing surface where straight portions join the curved portions and the curved portions serve to keep the puck from getting jammed or slowing down upon encountering the corner.

In some embodiments, the air hockey table 100 has more than two goals. The plurality of goals enables several players to play each other simultaneously. The air hockey table 100 and the other air hockey tables disclosed herein offer a different type of play in that they are at least partially curved unlike conventional rectangular air hockey tables. It is noted that the elements of the air hockey table 100 of FIG. 1 and the other figures may be out of proportion in order to accurately show the elements.

The air hockey table 100 of FIG. 1 is an embodiment of a curved air hockey table in the shape of a circle or that is substantially round. More specifically, a playing surface 110 is in the shape of a circle as defined by an edge 112 that bounds the playing surface 110. The edge 112 may extend substantially perpendicular from the playing surface 110 a distance 126 and serves to keep the puck 120 on the playing surface 110 during play. The distance 126 is large enough to keep the puck 120 on the playing surface 110, but short enough so as not to impede play. The edge 112 has goals formed therein or is associated with goals as described below. The term "edge" as used herein refers to a side of an air hockey table that is able to accommodate or be associated with a goal. The edges also provide boundaries of the playing surface 110.

Figure 2:
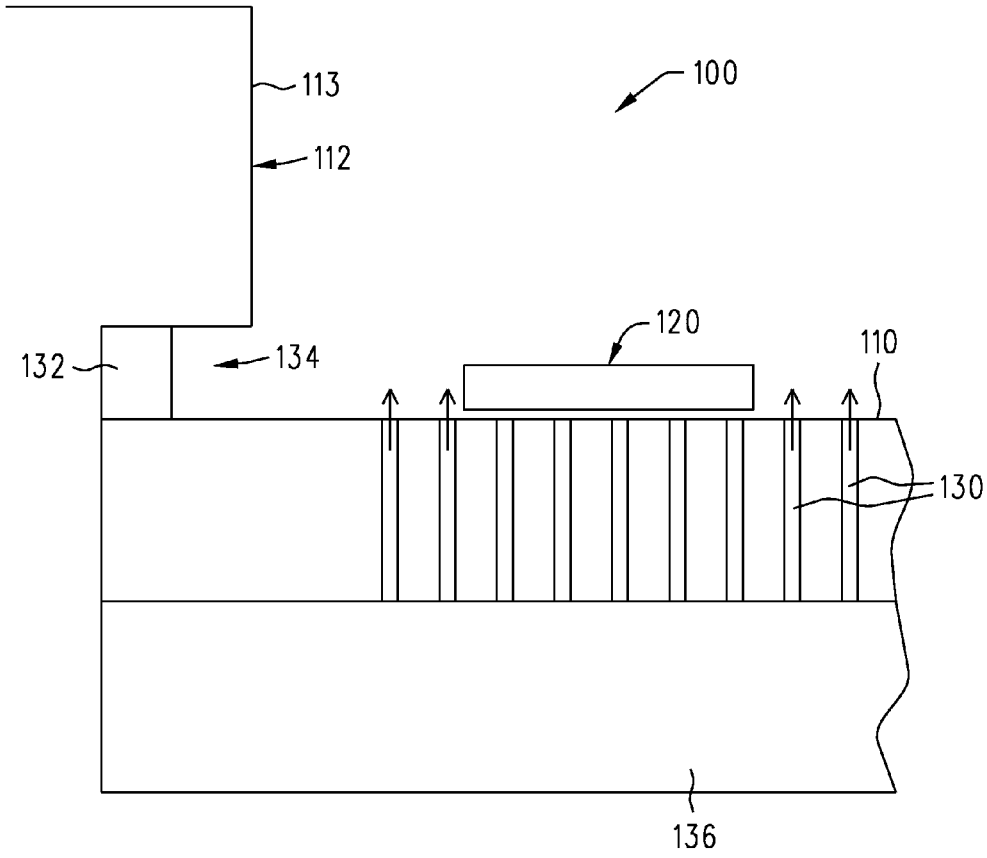
FIG. 2 is a partial, side cut away view of an embodiment of a side of the air hockey table of FIG. 1.

A side cut away view of an embodiment of the air hockey table 100 and the edge 112 is shown in FIG. 2. As shown in FIG. 2, the edge 112 has a face 113 and a recessed portion 134. A material 132 may be located within the recessed portion 134. The material 132 may be an elastic material, such as rubber. The material 132 may be material that is replaceable on the edge 112. Therefore, after considerable wear, the material 132, and not the entire edge 112, may be replaced. In some embodiments, there is no material 132, but there may be a recessed portion 134. In other embodiments, the recessed portion 134 may be eliminated. In other embodiments, the material 132 may protrude from the edge 112.

The playing surface 110 has a plurality of through holes 130 that are connected to an air source, such as a pressurized air source (not shown). In some embodiments, a fan or the like is used to force air under the playing surface 110 where it passes through a duct 136 and to the holes 130. The pressure created by the air passing through the holes 130 at least partially counteracts gravitational force on the puck 120 so that the puck 120 at least partially floats on the air. This is sometimes referred to as an air cushion.

The air hockey table 100 may have at least one goal. In the embodiment of FIG. 1, the air hockey table 100 has three goals, which are referred to individually as the first goal 140, the second goal 142, and the third goal 144. The goals 140, 142, 144 of FIG. 1 are openings in the face 113 of the edge 112. The goals 140, 142, 144 are sized to receive the puck 120. In other embodiments, the goals maybe recessed portions of the playing surface 110. In summary, the goals may be any device or portion of the air hockey table 110 that captures or otherwise stops the puck 120 when the puck 120 passes a predetermined location. In other embodiments, the goals may be locations that the puck 120 passes to indicate that a goal has been scored.

During play, players are located proximate their respective goals 140, 142, 144 of the air hockey table 100. An embodiment will be described in greater detail below where two players may play on the air hockey table 100, but for this example, three players are present. Each player tries to prevent the puck 120 from entering his goal (the goal proximate the player) and tries to get the puck 120 into the goal of an opposing player. The players may use mallets or paddles commonly used in the game of air hockey to strike and/or guide the puck 120. There may be several ways to win. In one embodiment, the player with the least number of goals scored against him after a predetermined period is deemed the winner. In another embodiment, players are removed after a predetermined number of goals are scored against them. The last remaining player is deemed the winner.

Having described some of the basic embodiments of the air hockey table 100, other embodiments will now be described. In some embodiments of the air hockey table 100, barricades or the like may be moved into a position to block the puck 120 from entering a goal 140, 142, 144. For example, if only two players want to play on the air hockey table 100, the third goal may be barricaded or blocked. In other embodiments, during play, if a player has a predetermined number of goals scored against him, he may have been deemed to have lost and the barricade associated with his goal may close. In such a situation, the remaining players may play without the game being impeded by an open goal of the player that lost.

In the embodiment of FIG. 1, each of the goals 140, 142, 144 has a slot in front of it. The slots extend into the playing surface 110. The slots are referred to individually as the first slot 150, the second slot 152, and the third slot 154. As described with reference to FIG. 3, the barricades may be in the slots 150, 152, 154 and may be raised through the slots to deactivate their respective goals.

Figure 3:
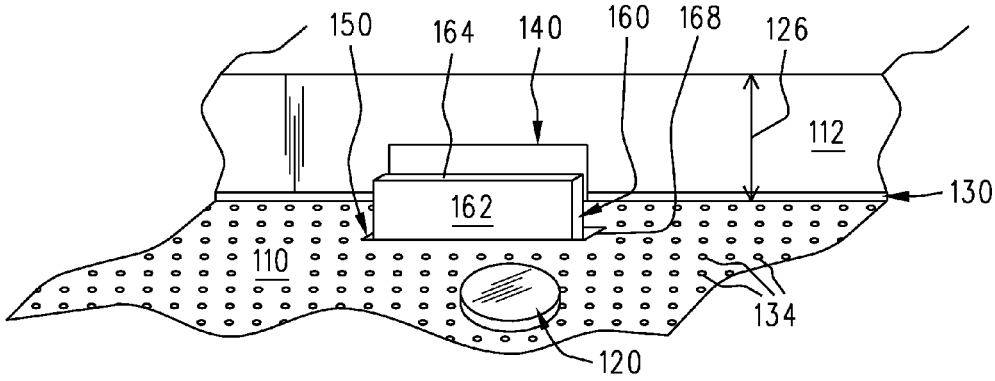
FIG. 3 is a front perspective view of an embodiment of the first goal of the air hockey table of FIG. 1 with a barricade extended.
Figure 4:
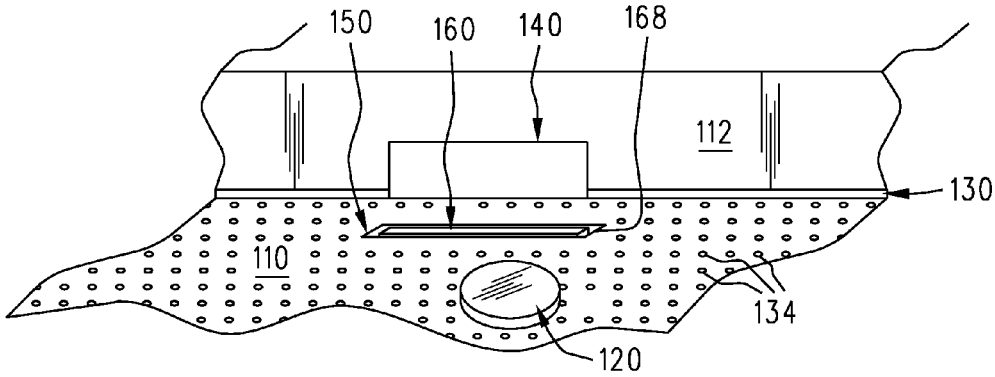
FIG. 4 is the view of FIG. 3 with the barricade recessed.

FIG. 3 is a front perspective view of the proximity of the first goal 140 with a barricade 160 in an extended position, which blocks the puck 120 from entering the first goal 140. When a barricade is in an extended position to block the puck 120 from entering a goal, the barricade is sometimes referred to as being in a first position. FIG. 4 is the same view as FIG. 3, except the barricade 160 is recessed below or even with the playing surface 110 so as to allow the puck 120 to enter the first goal 140. When a barricade is in a position to allow the puck 120 to pass to the goal, the barricade is sometimes referred to as being in a second position. Although FIGS. 3 and 4 refer to the first goal 140 and barricade 160, they are applicable the other goals and barricades described herein. The barricade 160 of FIG. 3 has a front face 162 and a top surface 164. The front face 162 serves to stop the puck 120 from entering the first goal 140. In many circumstances, the puck 120 will be deflected off the front face 162 of the barricade 160. In other circumstances, the puck 120 is deflected off either side of the barricade 160.

When the barricade 160 is recessed as shown in FIG. 4, the puck 120 may enter the first goal 140. In addition, the top surface 164 of the barricade 160 may be even with the playing surface 110. When the surfaces 110, 164 are even, the movement of the puck 120 over the first slot 150 is less likely to be impeded. In addition, the slot 150 may be narrow enough to as not to impede the movement of the puck 120 as the puck 120 passes over the slot 150. The slot 150 has a perimeter 168 that may be tapered downward from the playing surface 110. This taper reduces the interference that the puck 120 may encounter when it passes over the slot 150. The above-described devices for enabling the puck 120 to pass unimpeded over the slot 150 also apply to mallets or paddles used by players to strike the puck 120. Mallets and paddles may also pass over the slot 150 unimpeded.

In other embodiments, air is forced out of the slot 150. The air serves to keep the puck 120 elevated as it passes over the slot 150. More specifically, as the puck 120 passes over the slot 150, air emitted from the slot 150 serves to elevate the puck 120 so that the puck travels unimpeded over the slot 150.

Figure 5:
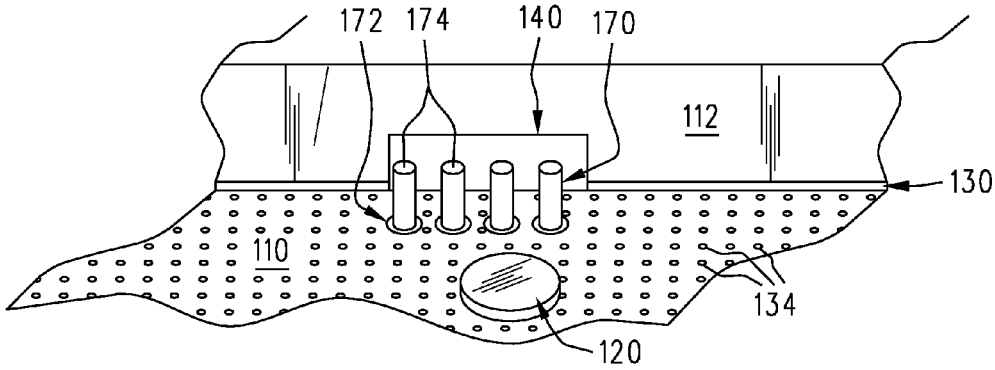
FIG. 5 is a front perspective view of another embodiment of a barricade.

Another embodiment of a barricade system is shown in FIG. 5 which discloses a plurality of pins 170 that extend through a plurality of holes 172 from the playing surface 110. The pins 170 function substantially similar to the barricade 160 described above. The pins 170 have top surfaces 174 that may be substantially flat. When the pins 170 are extended as shown in FIG. 5, the puck 120 is prevented from entering the first goal 140. When the pins 170 are retracted into the holes 172, the flat surfaces 174 of the pins 170 may be even with the playing surface 110. Accordingly, neither the puck 120 nor mallets or paddles will interfere with the pins 170 as they travel across the holes 172.

Figure 6:
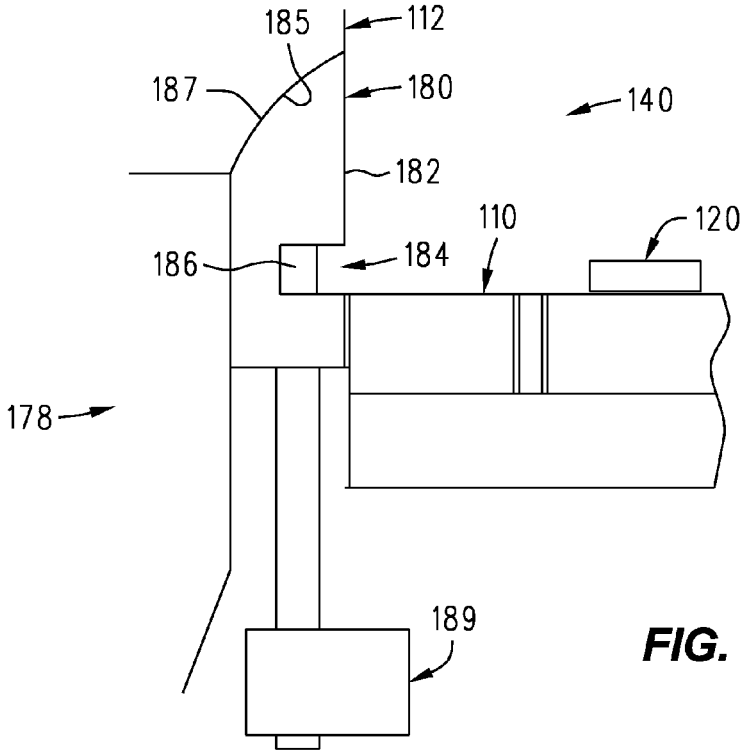
FIG. 6 is a side cut away view of a goal showing another embodiment of a barricade in a first or extended position.

Another embodiment of a barricade 180 is shown in FIG. 6, which is a side cut away view of the first goal 140. The first goal 140 and, in some embodiments, all the goals, have a puck receiver 178 that is used to hold the puck 120 after it passes through the first goal 140. Depending on the status of the game, the puck 120 may be kept in the puck receiver 178 to end a game or returned to a player to continue game play.

The barricade 180 extends into the edge 112 and, therefore, does not interfere or modify the playing surface 110 when it is extended as shown in FIG. 6. The barricade 180 has a front or first surface 182 that resembles the portion of the edge 112 that intersects the playing surface 110. With additional reference to FIG. 2, the barricade 180 has a recessed portion 184 and a material 186 that are substantially similar or identical to the recessed portion 134 and material 132 of the edge 112 as described with reference to FIG. 2. Accordingly, when the barricade 180 is in the extended or first position as shown in FIG. 6, the edge 112 is substantially uniform without any, or very few, inconsistencies when the first goal 140 is blocked.

The barricade 180 has a top surface 187 that may be shaped to fit into a corresponding surface 185 within the edge 112. The top surface 187 as shown in FIG. 6 is curved and fits into an opposing curve in the surface 185 within the edge 112. The curved, or otherwise slanted shape, of the top surface 187 serves to maintain the barricade 180 in a fixed position relative to the edge 112 even if the barricade 180 is struck by the puck 120. Therefore, there will be little difference in the rebounding characteristics of the puck 120 between the edge 112 and the barricade 180. When the barricade 180 is in the second or retracted position that allows the puck 120 to enter the puck receiver 178, the curved top surface 187 facilitates the puck 120 entering the puck receiver 178.

Figure 7:
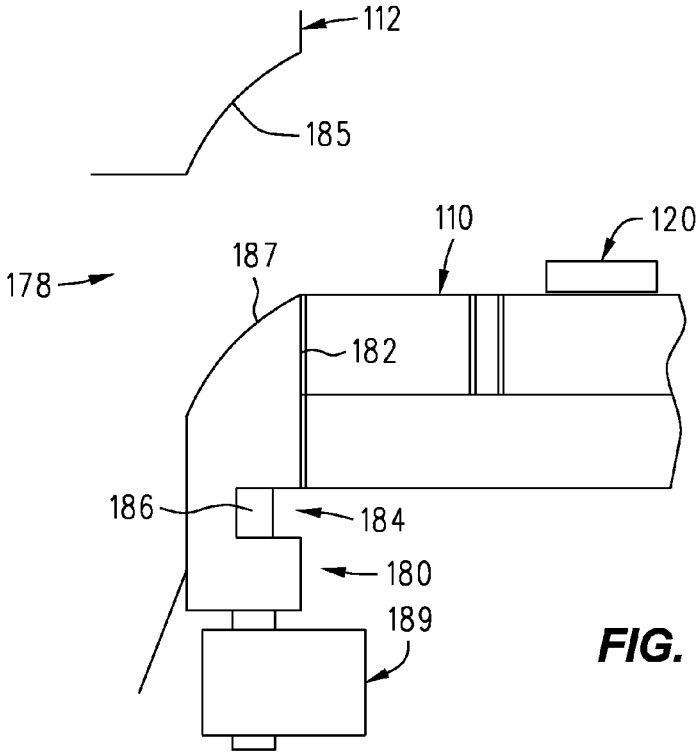
FIG. 7 is the view of FIG. 6 with the barricade in a retracted or second position.

The barricade 180 is connected to or otherwise coupled to an actuator 189 which moves the barricade 180 between the extended position shown in FIG. 6 and a retracted position shown in FIG. 7. The actuator 189 may use electromagnetism, servos, hydraulics, or other systems to move the barricade 180.

Having described the barricades, embodiments of different shaped air hockey tables will now be described in greater detail. The edge 112 defines the shape of the playing surface 110. As described above, the playing surface 110 may be at least partially curved or may have portions that are curved. In some embodiments, the edge 112 may have concave portions. In order to prevent the puck 120 from getting stuck in these concave portions, the radius of the concave portions may be greater than the radius of the puck 120. It is noted that pucks other than round pucks may be used. Therefore, the diameters of these pucks may be less than the radii of the concave portions.

Figure 8:
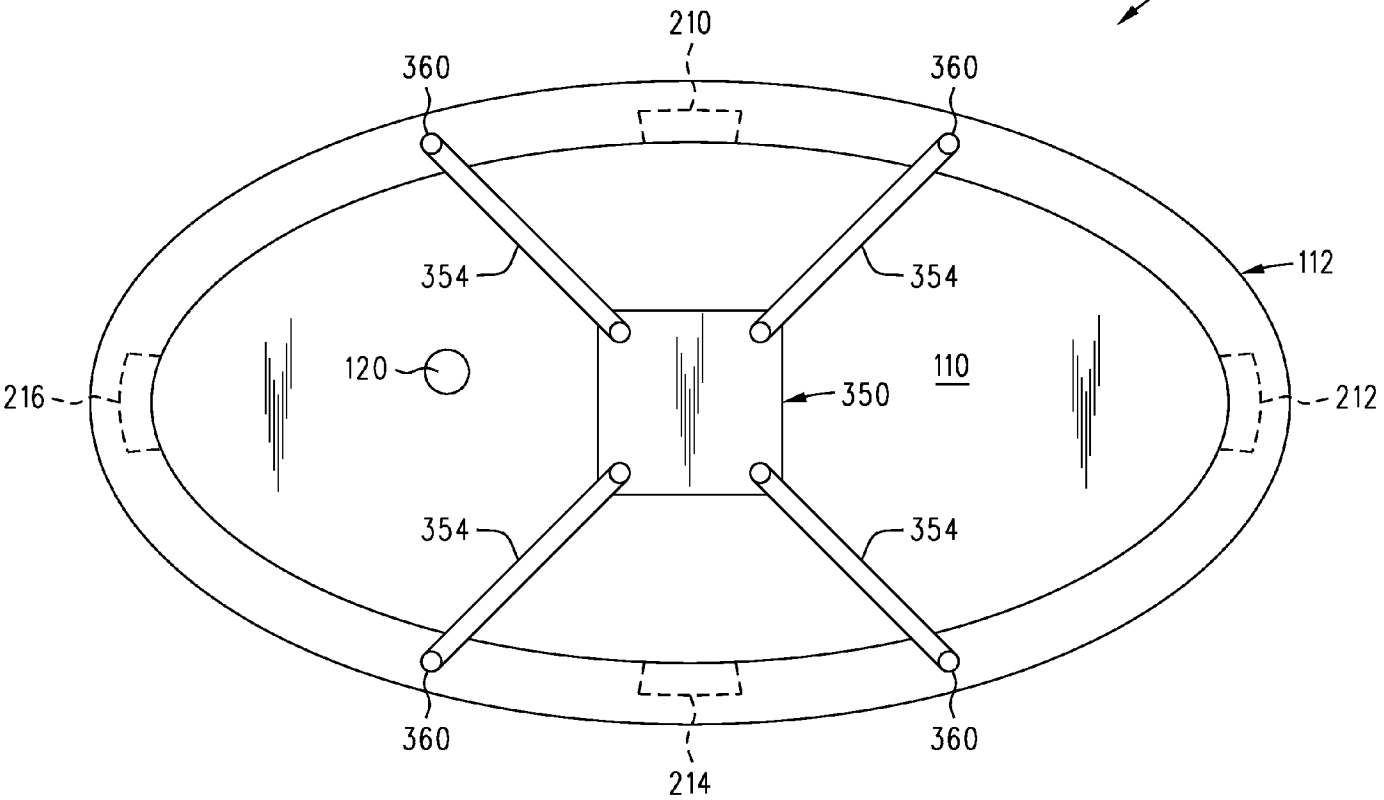
FIG. 8 is a top plan view of an embodiment of an oval air hockey table.

A top plan view of an embodiment of an oval air hockey table 200 is shown in FIG. 8. The air hockey table 200 of FIG. 8 has four goals that are referred to individually as a first goal 210, a second goal 212, a third goal 214, and a fourth goal 216. The goals 210, 212, 214, 216 may be substantially the same as the goals described above with reference to the air hockey table 100. It is noted that the air hockey table 200 may have fewer or greater than four goals. The playing surface 110 may be the same as described above except for the shape. The use of an oval causes the first goal 210 to be close to the third goal 214 and the second goal 212 to be far from the fourth goal 216. This configuration may be conducive to team play wherein a first team has the first goal 210 and the second goal 212. The second team has the third goal 214 and the fourth goal 216.

The air hockey table 200 enables up to four players to play simultaneously. Because the goals 210, 212, 214, 216 may have barricades associated with them, fewer than four players may play because a goal will not be left open. When a player has a predetermined number of goals scored against him, the barricade associated with his goal may block the goal, so the player may not continue to play. The last remaining player may be deemed the winner. In another embodiment of a game, the players may play for a predetermined period. The player with the fewest goals scored against him at the end of the period may be deemed the winner.

Figure 9:
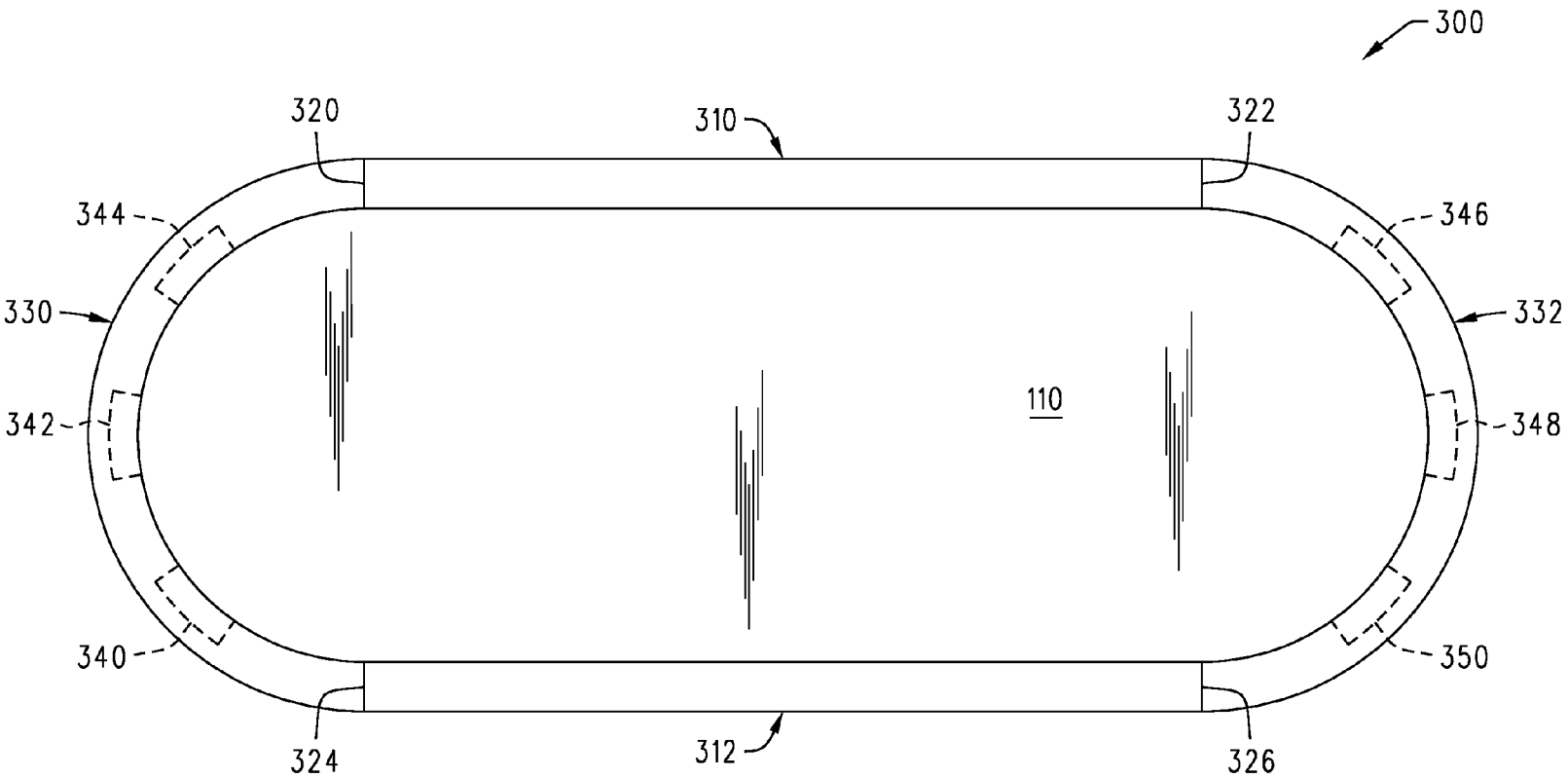
FIG. 9 is an embodiment of another version of an air hockey table.

A top plan view of another embodiment of an air hockey table 300 is shown in FIG. 9. The air hockey table 300 has a first portion 310 and a second portion 312 that may be substantially straight. The first portion 310 has a first end 320 and an opposite second end 322. The second portion 312 also has a first end 324 and an opposite second end 326. In some embodiments, the first portion 310 is straight and the second portion 312 may be straight. In other embodiments, both the first portion 310 and the second portion 312 are straight. In yet another embodiment, both the first portion 310 and the second portion 312 are straight and parallel to each other.

The first portion 310 and the second portion 312 may be joined by a curved third portion 330 and a curved fourth portion 332. More specifically, the third portion 330 may join the first end 320 of the first portion 310 to the first end 324 of the second portion 312. Likewise, the second end 322 of the first portion 310 is connected to the second end 326 of the second portion 312 by the fourth portion 332. The third portion 330 and/or the fourth portion 332 may be semicircular, elliptical, or simply curved.

The perimeter of the air hockey table 300 may have a plurality of goals associated therewith. In the embodiment of FIG. 9, the air hockey table 300 has six goals, three in the third portion 330 and three in the fourth portion 332. The goals in the third portion 330 are referred to individually as the first goal 340, the second goal 342, and the third goal 344. The goals in the fourth portion 332 are referred to individually as the fourth goal 346, the fifth goal 348, and the sixth goal 350. It is noted that goals may also be associated with the first portion 310 and the second portion 312.

The configuration of goals in the air hockey table 300 enables a plurality of individual players or teams to play simultaneously. For example, a first team may be associated with the first goal 340, the second goal 342, and the third goal 344. A second team may be associated with the fourth goal 346, the fifth goal 348, and the sixth goal 350.

Several different configurations of air hockey tables have been described above. It is noted that the air hockey tables may be made with any number of goals and may have a plurality of shapes.

Some embodiments of the air hockey tables have scoring mechanisms associated with them. The scoring mechanisms may be in the form of a score board located above the playing surface 110 or score indications associated with each goal, wherein each goal is associated with a specific player. Referring to FIG. 8, a scoreboard 350 may be suspended above the playing surface 110 by a plurality of rods 354. The rods 354 may extend between holes 360 in the edge 112 and the scoreboard 350. The rods 354 may be used with all of the configurations of the air hockey tables. Although, their lengths may have to be modified slightly depending on the shape and size of the air hockey tables.

The scoreboard 350 may have a plurality of sides that display score. The number of sides on the scoreboard 350 may correspond to the number of goals or sides of the air hockey table. With regard to the oval air hockey table 200 of FIG. 8, the scoreboard 350 has four sides, one for each player when the maximum of four players are playing. Each side of the scoreboard 350 may display the number of goals or points scored against the goal the side is facing. For example, the player at the first goal 210 can look at the scoreboard 350 and see the number of goals or points that have been scored in the first goal 210. In addition, each side may display the number of goals or points scored against other players. The scoreboard 350 may also indicate the scores of teams during team play.

The air hockey tables described above may have different numbers of players playing at any time. For example, the oval air hockey table 200 may have four players starting the game. As the game progresses, players may be eliminated. In some embodiments, new players may join a game in progress. A computer or computer processor running a program on a computer-readable medium may control the game, including barricades, scoring, puck return, and air flow to the playing surface 110 as described below.

Figure 10:
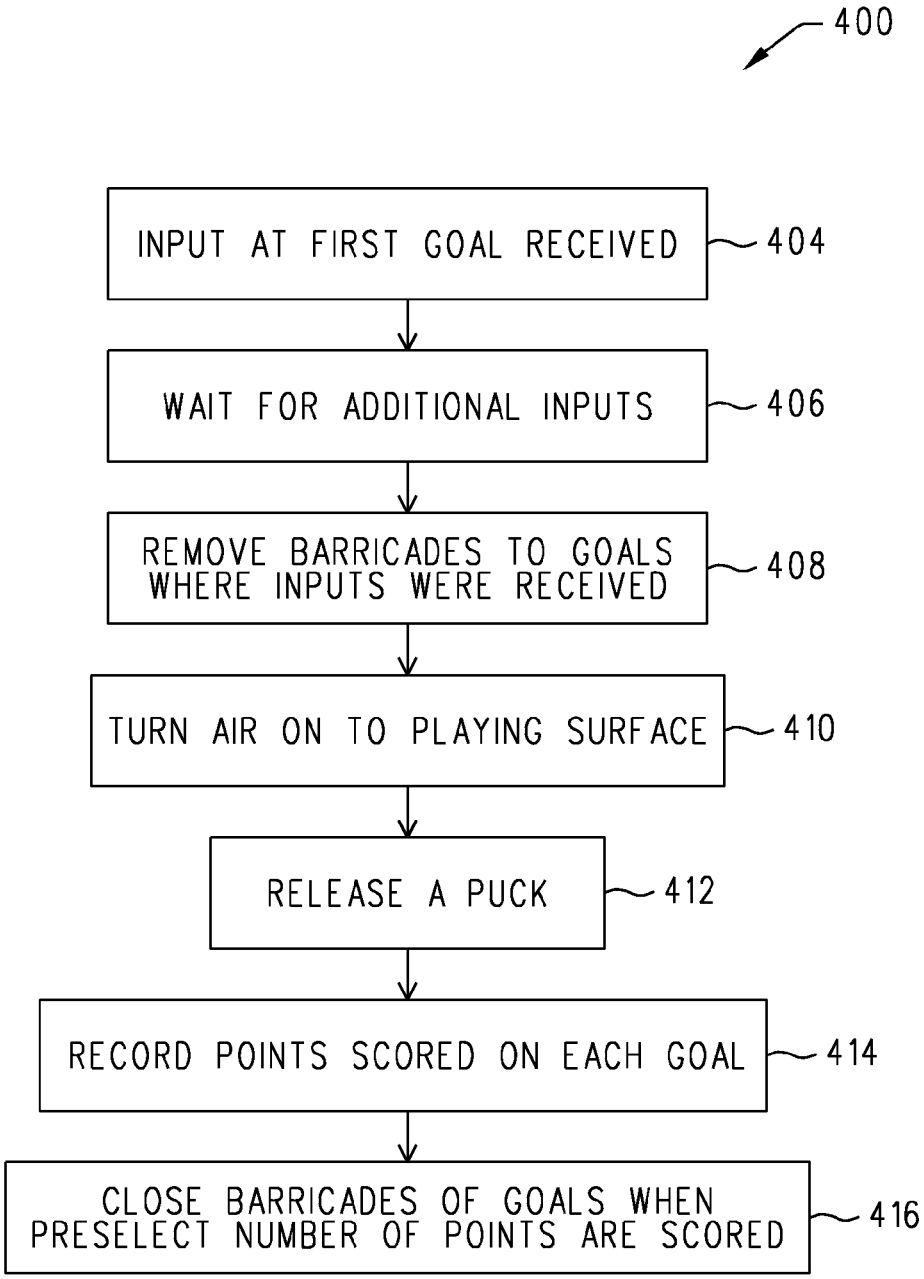
FIG. 10 is a flow chart describing an embodiment of playing air hockey on the air hockey tables.

One embodiment of playing a multiple player air hockey game is shown by the flowchart 400 of FIG. 10. The flowchart 400 is applicable to many of the air hockey tables described above. The steps described in regard to the flowchart 400 may be performed by a computer or other electronic device. In some embodiments, the steps of the flowchart 400 are performed by software running on a computer. In step 404, the air hockey table receives an input indicating that a player wants to play. The input is received at or in association with a goal. For example, the input may be in the form of money inserted into a money receiving device associated with the first goal. In other embodiments, buttons or the like may be depressed indicating that a player wants to play at the first goal.

At step 406, the air hockey table may wait a preselected period for other players to join the game. This joining may be accomplished by the players inserting more coins or providing other indications. The indications may also indicate which goal the players are to be associated with.

At this time, the number of players and their positions are established. At step 408, the barricades associated with these players are then removed or put in the second position that enables the puck 120 to pass past the barricades and into the goals. At the same time, the air may be turned on so that air passes to the playing surface 110 as described above and as shown at step 410. A puck 120 may then be released as shown in the step 412.

The game may then commence. During the game, the players may try to eliminate other players by scoring goals or points against the other players. The number of goals scored against each player may be recorded as shown at step 414. The game may be played in several different versions that are applicable to step 416. In one version, the goals are counted. When a player has a preselected number of goals scored against him, his barricade is placed into the first position, which prevents the puck 120 from entering the goal. This player has been eliminated. A light or other indicator may also provide an indication that the player has been eliminated. The game may continue until there is one player remaining, who is deemed the winner.

In another embodiment, the goals or points are counted for a specific period. The person with the least number of goals scored against him after the end of the period is deemed the winner. In yet another embodiment, teams may play. A keypad or other input device may be used to establish teams. For example, with the air hockey table 300 of FIG. 9, the players may be in teams, such as three teams of two players or two teams of three players. A keyboard or the like may be used to enter team information into the air hockey table or a computer operating the air hockey table. As with the previous versions of the games, a team may be eliminated when a preselected number of goals are scored against it. Alternatively, after a preselected period, the game may end and the team with the fewest goals scored against it is deemed the winner.

In some embodiments, players may enter a game that is in play. For example, if three players are playing the air hockey table 300 of FIG. 9, a fourth player may enter the game. The fourth player may provide an input to the air hockey table 300 or the computer controlling the air hockey table 300 that he wants to enter the game. In some embodiments, the fourth player puts money into a money receiver associated with a goal. The barricade associated with the goals moves to the second position to allow the puck to enter the goal. The new player may commence playing with the greatest number of points or goals of any other player. As an example, if the second player is losing with two goals, the fourth player may start the game with two goals.

The description above relates to many embodiments of air hockey tables and different methods to play air hockey. Further embodiments of air hockey tables will now be disclosed.

Referring to FIG. 1, lights 450 may be put on the edge 112 proximate the goals 140, 142, 144 to indicate whether the goal or goals associated with a side are active. More specifically, the lights 450 may indicate the status of the barricade. For example, a first color light may indicate that the barricade is in the first position meaning that a player using the goal has been eliminated or has not yet entered a game. A second color light may indicate that the barricade is recessed or in the second position, which enables the player to play. This indication may inform the player of his status. For example, a player may not be able to see his goal because of his position relative to the air hockey table. The lights provide such an indication. In a similar embodiment, lights 460 may be placed on the face 113. The lights 460 may serve the same function as the lights 450, but they may be seen better by the other players and may also illuminate the playing surface 110 proximate their respective goals.

Referring to FIGS. 6 and 7, lighting may also be used in the goals. For example, a light may be located in the puck receiver 178, which causes light to be emitted from the associated goal when the barricade 180 is recessed or in the second position. In a related embodiment, at least a part of the barricade may be translucent and two different colored light sources may be located in the puck receiver 178. The light emitted by the translucent portion of the barricade 180 indicates that the barricade is up and the player associated therewith should not be playing.

Referring again to FIG. 1, the lights 450, 460 may also be used for other purposes. For example, at the start of a game, the players need to obtain a puck 120 from a puck receiver 178. The lights 450, 460 may provide an indication as to the location of the puck. In addition, the lights 450, 460 may indicate which player is in the lead during a game or which player is losing. At the end of a game, the lights 450, 460 may indicate which player won. The lights 450, 460 may also indicate when a goal has been scored and against whom.

The outer sides of the air hockey tables may contain ledges or the like that may hold beverages or other items. These ledges are on the outer sides in order to prevent the beverages or other items from being spilled or otherwise placed on the playing surfaces 110. The tops of the sides may be curved or otherwise shaped to prevent people from placing items on the tops of the sides. Accordingly, by preventing items from being so placed, the items are less likely to spill or otherwise be located on the playing surfaces 110.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. An air hockey table comprising:

a playing surface that is at least partially curved;

a plurality of air paths extending through said playing surface, wherein air is emittable by said plurality of air paths, and wherein said puck is at least partially floatable on air that is emittable by said plurality of air paths; and at least one goal and at least one barricade, wherein at least one barricade is movable proximate said at least one goal, said barricade having a first position wherein said puck is prevented from entering said at least one goal and a second position wherein said puck is able to enter said goal.

2. The air hockey table of claim 1, wherein said playing surface is circular.

3. The air hockey table of claim 1, wherein said playing surface is oblong.

4. The air hockey table of claim 1, wherein said playing surface is oval.

5. The air hockey table of claim 1, and further comprising at least two goals.

6. The air hockey table of claim 1, and further comprising at least one edge bounding said playing surface, said at least one edge having at least two goals formed therein.

7. The air hockey table of claim 1, wherein said barricade comprises at least one pin.

8. The air hockey table of claim 1 and further comprising:

an edge bounding said playing surface, wherein the at least one goal is formed into said edge; and wherein when said barricade is in said first position said at least one goal is substantially even with said edge associated with said goal.

9. The air hockey table of claim 1, wherein the shape of said playing surface comprises two substantially straight portions, each substantially straight portion having two ends, wherein the ends of said two straight portions are joined by curved portions.

10. The air hockey table of claim 1, wherein the shape of said playing surface comprises at least two substantially linear portions, each substantially linear portion having two ends, wherein the ends of at least two linear portions are joined by at least one curved portion.

11. The air hockey table of claim 1 and further comprising at least one light, said at least one light indicating the status of a game played on said air hockey table.

12. The air hockey table of claim 1 wherein said barricade is in said second position when it is located below said playing surface so as not to impede a puck passing through said goal.

13. An air hockey table comprising:

a playing surface, said playing surface being bounded by an edge, said edge being at least partially curved, at least one opening associated with said edge, wherein a puck is receivable in said opening;

a plurality of air paths extending through said playing surface, wherein air is emittable by said plurality of air paths, and wherein said puck is at least partially floatable on air that is emittable by said plurality of air paths; and at least one barricade, wherein said at least one barricade is movable proximate said at least one opening, said barricade having a first position wherein said barricade blocks said at least one opening and is substantially even with said edge associated with said opening, and wherein said puck is prevented from entering said opening, and wherein said barricade has a second position wherein said puck is able to enter said opening when said barricade is in said second position.

14. The air hockey table of claim 13, wherein said edge is circular.

15. The air hockey table of claim 13, wherein said edge is oblong.

16. The air hockey table of claim 13, wherein said edge is oval.

17. The air hockey table of claim 13, wherein said edge comprises at least two substantially linear portions, each substantially linear portion having two ends, wherein the ends of at least two linear portions are joined by at least one curved portion.

18. The air hockey table of claim 13, wherein said barricade is in said second position when it is located below said playing surface so as not to impede a puck passing through said opening.

19. A method of playing air hockey on an air hockey table, said air hockey table comprising an at least partially curved playing surface and at least two openings sized to receive said puck, said method comprising:

opening a goal associated with each player; and counting the number of times a puck enters each opened goal.

20. The method of claim 19, wherein said air hockey table comprises at least one barricade associated with at least one goal, said barricade having a first position wherein a puck is prevented from entering said goal and a second position wherein said puck may enter said goal, and wherein said opening a goal comprises moving said barricade to said second position.

21. The method of claim 19 and further comprising closing goals associated with players who have a preselected number of goals scored against them.

22. The method of claim 19 and further comprising closing said goals after a preselected period.

* * * * *